US008696150B2

(12) United States Patent
Moore

(10) Patent No.: US 8,696,150 B2
(45) Date of Patent: Apr. 15, 2014

(54) LOW-PROFILE SIDE MOUNTED LASER SIGHTING DEVICE

(76) Inventor: Larry E. Moore, Cottonwood, AZ (US)

( * ) Notice: Subject to any disclaimer, the term of this patent is extended or adjusted under 35 U.S.C. 154(b) by 13 days.

(21) Appl. No.: 13/353,301

(22) Filed: Jan. 18, 2012

(65) Prior Publication Data

US 2012/0224357 A1 Sep. 6, 2012

Related U.S. Application Data

(60) Provisional application No. 61/433,874, filed on Jan. 18, 2011.

(51) Int. Cl.
*F41G 1/34* (2006.01)

(52) U.S. Cl.
USPC ..... 362/110; 362/191

(58) Field of Classification Search
USPC ..... 362/110, 113, 114, 191; 42/115, 142, 42/146; 29/592.1
See application file for complete search history.

(56) References Cited

U.S. PATENT DOCUMENTS

| | | | |
|---|---|---|---|
| 1,898,566 | A | 2/1933 | Noel |
| 2,268,056 | A | 12/1941 | Nelson et al. |
| 2,357,951 | A | 9/1944 | Hale |
| 2,597,565 | A | 5/1952 | Chandler et al. |
| 2,773,309 | A | 12/1956 | Elliot |
| 2,780,882 | A | 2/1957 | Temple |
| 2,826,848 | A | 3/1958 | Davies |
| 3,112,567 | A | 12/1963 | Flanagan |
| 3,192,915 | A | 7/1965 | Norris et al. |
| 3,510,965 | A | 5/1970 | Rhea |
| 3,526,972 | A | 9/1970 | Sumpf |
| 3,573,868 | A | 4/1971 | Giannetti |
| 3,641,676 | A | 2/1972 | Knutsen et al. |
| 3,645,635 | A | 2/1972 | Steck |
| 3,801,205 | A | 4/1974 | Eggenschwyler |
| 3,914,873 | A | 10/1975 | Elliott, Jr. et al. |
| 3,992,783 | A | 11/1976 | Dunlap et al. |

(Continued)

FOREIGN PATENT DOCUMENTS

| | | |
|---|---|---|
| EP | 1046877 | 10/2000 |
| FR | 862247 | 3/1941 |

OTHER PUBLICATIONS

USPTO; Office Action dated Feb. 20, 2013 in U.S. Appl. No. 13/670,278.

(Continued)

*Primary Examiner* — Nimeshkumar Patel
*Assistant Examiner* — Glenn Zimmerman
(74) *Attorney, Agent, or Firm* — Snell & Wilmer LLP

(57) ABSTRACT

A lighting device is mountable on the side of an automatic pistol by using openings already formed in the pistol body to connect the pistol body to the frame rail of the pistol using frame insert pins. In a retrofit application, to connect the lighting device to the pistol, the frame insert pins are removed from the pistol, the lighting device is aligned with the side of the pistol such that one or more apertures of the lighting device align with an opening in which the frame insert pin(s) were removed, and either the same frame insert pins, or slightly longer ones, are inserted through the aligned apertures and openings. In this manner, the lighting device is mounted to a side of the body of the pistol, and the side portion of the body of the pistol is again connected to the frame rail.

24 Claims, 10 Drawing Sheets

(56) References Cited

U.S. PATENT DOCUMENTS 3,995,376 A 12/1976 Kimble et al.
4,079,534 A 3/1978 Snyder
4,148,245 A 4/1979 Steffanus et al.
4,156,981 A 6/1979 Lusk
4,220,983 A 9/1980 Schroeder
4,222,564 A 9/1980 Allen
4,233,770 A 11/1980 de Filippis et al.
4,234,911 A 11/1980 Faith
4,295,289 A 10/1981 Snyder
4,305,091 A 12/1981 Cooper
4,348,828 A 9/1982 Snyder
4,481,561 A 11/1984 Lanning
4,488,369 A 12/1984 Van Note
4,541,191 A 9/1985 Morris et al.
4,567,810 A 2/1986 Preston
4,763,431 A 8/1988 Allan et al.
4,825,258 A 4/1989 Whitson
4,830,617 A 5/1989 Hancox et al.
4,876,816 A 10/1989 Triplett
4,878,307 A 11/1989 Singletary
4,891,476 A 1/1990 Nation et al.
4,934,086 A 6/1990 Houde-Walter
4,939,320 A 7/1990 Graulty
4,939,863 A 7/1990 Alexander et al.
4,953,316 A 9/1990 Litton et al.
4,967,642 A 11/1990 Mihaita
5,001,836 A 3/1991 Cameron et al.
5,033,219 A 7/1991 Johnson et al.
5,048,211 A 9/1991 Hepp
5,048,215 A 9/1991 Davis
5,052,138 A 10/1991 Crain
5,090,805 A 2/1992 Stawarz
5,177,309 A 1/1993 Willoughby et al.
5,178,265 A 1/1993 Sepke
5,179,124 A 1/1993 Schoenwald et al.
5,179,235 A 1/1993 Toole
5,228,427 A 7/1993 Gardner
5,237,773 A 8/1993 Claridge
5,241,146 A 8/1993 Priesemuth
5,272,514 A 12/1993 Dor
5,299,375 A 4/1994 Thummel et al.
5,343,376 A 8/1994 Huang
5,355,608 A * 10/1994 Teetzel ..... 42/117
5,355,609 A 10/1994 Schenke
5,365,669 A 11/1994 Rustick et al.
5,367,779 A 11/1994 Lee
5,373,644 A 12/1994 De Paoli
5,375,362 A 12/1994 McGarry et al.
5,388,335 A 2/1995 Jung
5,392,550 A 2/1995 Moore et al.
5,419,072 A 5/1995 Moore et al.
5,432,598 A 7/1995 Szatkowski
5,435,091 A 7/1995 Toole et al.
5,446,535 A 8/1995 Williams
5,448,834 A 9/1995 Huang
5,454,168 A 10/1995 Langer
5,455,397 A 10/1995 Havenhill et al.
5,467,552 A 11/1995 Cupp et al.
5,481,819 A 1/1996 Teetzel
5,488,795 A 2/1996 Sweat
D368,121 S 3/1996 Lam
5,499,455 A 3/1996 Palmer
5,515,636 A 5/1996 McGarry et al.
5,531,040 A 7/1996 Moore
5,555,662 A 9/1996 Teetzel
5,557,872 A 9/1996 Langner
5,566,459 A 10/1996 Breda
5,581,898 A 12/1996 Thummel
5,584,137 A 12/1996 Teetzel
5,590,486 A 1/1997 Moore
5,598,958 A 2/1997 Ryan, III et al.
5,618,099 A 4/1997 Brubacher
5,621,999 A 4/1997 Moore
5,622,000 A 4/1997 Marlowe
5,669,174 A 9/1997 Teetzel
5,671,561 A 9/1997 Johnson et al.
5,685,106 A 11/1997 Shoham
5,685,636 A 11/1997 German
5,694,202 A 12/1997 Mladjan et al.
5,694,713 A 12/1997 Paldino
5,704,153 A 1/1998 Kaminski et al.
5,706,600 A 1/1998 Toole et al.
5,735,070 A 4/1998 Vasquez et al.
5,787,631 A 8/1998 Kendall
5,788,500 A 8/1998 Gerber
5,822,905 A 10/1998 Teetzel
5,842,300 A 12/1998 Cheshelski et al.
5,847,345 A 12/1998 Harrison
5,867,930 A 2/1999 Kaminski et al.
5,881,707 A 3/1999 Gardner
5,892,221 A 4/1999 Lev
5,896,691 A 4/1999 Kaminski et al.
5,905,238 A 5/1999 Hung
5,909,951 A 6/1999 Johnsen et al.
5,967,133 A 10/1999 Gardner
5,983,774 A 11/1999 Mihaita
6,003,504 A 12/1999 Rice et al.
6,023,875 A 2/2000 Fell et al.
6,035,843 A 3/2000 Smith et al.
6,146,141 A 11/2000 Schumann
6,151,788 A 11/2000 Cox et al.
6,219,952 B1 4/2001 Mossberg et al.
6,230,431 B1 5/2001 Bear
6,237,271 B1 5/2001 Kaminski
6,289,624 B1 9/2001 Hughes et al.
6,295,753 B1 10/2001 Thummel
6,301,046 B1 10/2001 Tai et al.
6,318,228 B1 11/2001 Thompson
6,345,464 B1 2/2002 Kim et al.
6,363,648 B1 4/2002 Kranich
6,366,349 B1 4/2002 Houde-Walter
6,371,004 B1 4/2002 Peterson
6,385,893 B1 5/2002 Cheng
6,389,729 B2 5/2002 Rauch et al.
6,389,730 B1 5/2002 Millard
6,397,509 B1 6/2002 Langner
6,430,861 B1 8/2002 Ayers et al.
6,434,874 B1 8/2002 Hines
6,442,880 B1 9/2002 Allan
6,487,807 B1 12/2002 Kopman et al.
6,499,247 B1 12/2002 Peterson
6,526,688 B1 3/2003 Danielson et al.
6,568,118 B1 5/2003 Teetzel
6,575,753 B2 6/2003 Rosa et al.
6,578,311 B2 6/2003 Danielson et al.
6,579,098 B2 6/2003 Shechter
6,591,536 B2 7/2003 Houde-Walter et al.
6,606,797 B1 8/2003 Gandy
6,616,452 B2 9/2003 Clark et al.
6,622,414 B1 9/2003 Oliver et al.
6,631,580 B2 10/2003 Iafrate
6,631,668 B1 10/2003 Wilson et al.
6,650,669 B1 11/2003 Adkins
6,671,991 B1 1/2004 Danielson
D487,791 S 3/2004 Freed
6,742,299 B2 6/2004 Strand
6,782,789 B2 8/2004 McNulty
6,854,205 B2 2/2005 Wikle et al.
6,931,775 B2 8/2005 Burnett
6,935,864 B2 8/2005 Shechter et al.
6,966,775 B1 11/2005 Kendir et al.
7,032,342 B2 4/2006 Pikielny
7,049,575 B2 5/2006 Hotelling
7,111,424 B1 9/2006 Moody et al.
7,121,034 B2 10/2006 Keng
7,134,234 B1 11/2006 Makarounis
7,191,557 B2 3/2007 Gablowski et al.
D542,446 S 5/2007 DiCarlo et al.
7,218,501 B2 5/2007 Keely
7,237,352 B2 7/2007 Keely et al.
7,243,454 B1 7/2007 Cahill
7,260,910 B2 8/2007 Danielson
7,264,369 B1 9/2007 Howe
7,303,306 B2 12/2007 Ross et al.

(56) References Cited

U.S. PATENT DOCUMENTS

| | | | | |
|---|---|---|---|---|
| 7,305,790 | B2 | 12/2007 | Kay | |
| 7,329,127 | B2 | 2/2008 | Kendir et al. | |
| 7,331,137 | B2 | 2/2008 | Hsu | |
| D567,894 | S | 4/2008 | Sterling et al. | |
| 7,360,333 | B2 | 4/2008 | Kim | |
| D570,948 | S | 6/2008 | Cerovic et al. | |
| RE40,429 | E | 7/2008 | Oliver et al. | |
| D578,599 | S | 10/2008 | Cheng | |
| 7,441,364 | B2 | 10/2008 | Rogers et al. | |
| 7,454,858 | B2 | 11/2008 | Griffin | |
| 7,464,495 | B2 | 12/2008 | Cahill | |
| 7,472,830 | B2 | 1/2009 | Danielson | |
| 7,490,429 | B2 | 2/2009 | Moody et al. | |
| 7,578,089 | B1 | 8/2009 | Griffin | |
| 7,584,569 | B2 | 9/2009 | Kallio | |
| 7,591,098 | B2 | 9/2009 | Matthews et al. | |
| D602,109 | S | 10/2009 | Cerovic et al. | |
| 7,603,997 | B2 | 10/2009 | Hensel et al. | |
| D603,478 | S | 11/2009 | Hughes | |
| 7,624,528 | B1 | 12/2009 | Bell et al. | |
| 7,627,976 | B1 | 12/2009 | Olson | |
| 7,644,530 | B2 | 1/2010 | Scherpf | |
| 7,652,216 | B2 | 1/2010 | Sharrah et al. | |
| D612,756 | S | 3/2010 | D'Amelio et al. | |
| D612,757 | S | 3/2010 | D'Amelio et al. | |
| 7,674,003 | B2 | 3/2010 | Sharrah et al. | |
| 7,676,975 | B2 | 3/2010 | Phillips et al. | |
| 7,685,756 | B2 | 3/2010 | Moody et al. | |
| 7,698,847 | B2 | 4/2010 | Griffin | |
| 7,703,719 | B1 | 4/2010 | Bell et al. | |
| 7,712,241 | B2 | 5/2010 | Teetzel et al. | |
| D616,957 | S | 6/2010 | Rievley et al. | |
| 7,726,059 | B2 | 6/2010 | Pikielny | |
| 7,726,061 | B1 | 6/2010 | Thummel | |
| 7,730,820 | B2 | 6/2010 | Vice et al. | |
| 7,743,546 | B2 | 6/2010 | Keng | |
| 7,743,547 | B2 | 6/2010 | Houde-Walter | |
| 7,753,549 | B2 | 7/2010 | Solinsky et al. | |
| 7,797,843 | B1 * | 9/2010 | Scott et al. | 33/227 |
| 7,805,876 | B1 | 10/2010 | Danielson et al. | |
| 7,818,910 | B2 | 10/2010 | Young | |
| 7,841,120 | B2 | 11/2010 | Teetzel et al. | |
| 7,880,100 | B2 | 2/2011 | Sharrah et al. | |
| 7,900,390 | B2 | 3/2011 | Moody et al. | |
| 7,913,439 | B2 | 3/2011 | Whaley | |
| D636,049 | S | 4/2011 | Hughes et al. | |
| D636,837 | S | 4/2011 | Hughes et al. | |
| 7,921,591 | B1 | 4/2011 | Adcock | |
| 7,926,218 | B2 | 4/2011 | Matthews et al. | |
| 8,028,460 | B2 | 10/2011 | Williams | |
| 8,028,461 | B2 | 10/2011 | NuDyke | |
| 8,050,307 | B2 | 11/2011 | Day et al. | |
| 8,056,277 | B2 | 11/2011 | Griffin | |
| 8,093,992 | B2 | 1/2012 | Jancie et al. | |
| 8,104,220 | B2 | 1/2012 | Cobb | |
| D653,798 | S | 2/2012 | Janice et al. | |
| 8,109,024 | B2 | 2/2012 | Abst | |
| 8,110,760 | B2 | 2/2012 | Sharrah et al. | |
| 8,136,284 | B2 | 3/2012 | Moody et al. | |
| 8,141,288 | B2 | 3/2012 | Dodd et al. | |
| 8,146,282 | B2 | 4/2012 | Cabahug et al. | |
| 8,151,504 | B1 | 4/2012 | Aiston | |
| 8,151,505 | B2 | 4/2012 | Thompson | |
| 8,166,694 | B2 | 5/2012 | Swan | |
| 8,172,139 | B1 | 5/2012 | McDonald et al. | |
| D661,366 | S | 6/2012 | Zusman | |
| 8,196,328 | B2 | 6/2012 | Simpkins | |
| 8,215,047 | B2 | 7/2012 | Ash et al. | |
| 8,225,542 | B2 | 7/2012 | Houde-Walter | |
| 8,225,543 | B2 | 7/2012 | Moody et al. | |
| 8,245,428 | B2 | 8/2012 | Griffin | |
| 8,245,434 | B2 | 8/2012 | Hogg et al. | |
| 8,256,154 | B2 | 9/2012 | Danielson et al. | |
| 8,258,416 | B2 | 9/2012 | Sharrah et al. | |
| D669,552 | S | 10/2012 | Essig et al. | |
| D669,553 | S | 10/2012 | Hughes et al. | |
| D669,957 | S | 10/2012 | Hughes et al. | |
| D669,958 | S | 10/2012 | Essig et al. | |
| D669,959 | S | 10/2012 | Johnston et al. | |
| D670,785 | S | 11/2012 | Fitzpatrick et al. | |
| D672,005 | S | 12/2012 | Hedeen et al. | |
| 8,322,064 | B2 | 12/2012 | Cabahug et al. | |
| 8,335,413 | B2 | 12/2012 | Dromaretsky et al. | |
| D674,861 | S | 1/2013 | Johnston et al. | |
| D674,862 | S | 1/2013 | Johnston et al. | |
| D675,281 | S | 1/2013 | Speroni | |
| 8,341,868 | B2 | 1/2013 | Zusman | |
| 8,347,541 | B1 | 1/2013 | Thompson | |
| 8,360,598 | B2 | 1/2013 | Sharrah et al. | |
| D676,097 | S | 2/2013 | Izumi | |
| 8,365,456 | B1 | 2/2013 | Shepard | |
| D677,433 | S | 3/2013 | Swan et al. | |
| D678,976 | S | 3/2013 | Pittman | |
| 8,387,294 | B2 | 3/2013 | Bolden | |
| 8,393,104 | B1 | 3/2013 | Moody et al. | |
| 8,393,105 | B1 | 3/2013 | Thummel | |
| 8,397,418 | B2 | 3/2013 | Cabahug et al. | |
| 8,402,683 | B2 | 3/2013 | Cabahug et al. | |
| 8,413,362 | B2 | 4/2013 | Houde-Walter | |
| 8,443,539 | B2 | 5/2013 | Cabahug et al. | |
| 8,444,291 | B2 | 5/2013 | Swan et al. | |
| 8,448,368 | B2 | 5/2013 | Cabahug et al. | |
| 8,458,944 | B2 | 6/2013 | Houde-Walter | |
| 8,467,430 | B2 | 6/2013 | Caffey et al. | |
| 8,468,930 | B1 | 6/2013 | Bell | |
| D687,120 | S | 7/2013 | Hughes et al. | |
| 8,480,329 | B2 | 7/2013 | Fluhr et al. | |
| 8,484,882 | B2 | 7/2013 | Haley et al. | |
| 8,485,686 | B2 | 7/2013 | Swan et al. | |
| 8,516,731 | B2 | 8/2013 | Cabahug et al. | |
| 2002/0073561 | A1 | 6/2002 | Liao | |
| 2002/0134000 | A1 | 9/2002 | Varshneya et al. | |
| 2002/0194767 | A1 | 12/2002 | Houde-Walter et al. | |
| 2003/0003424 | A1 | 1/2003 | Shechter et al. | |
| 2003/0180692 | A1 | 9/2003 | Skala et al. | |
| 2003/0196366 | A1 | 10/2003 | Beretta | |
| 2004/0010956 | A1 | 1/2004 | Bubits | |
| 2005/0044736 | A1 | 3/2005 | Liao | |
| 2005/0188588 | A1 | 9/2005 | Keng | |
| 2005/0241209 | A1 | 11/2005 | Staley | |
| 2005/0257415 | A1 | 11/2005 | Solinsky et al. | |
| 2005/0268519 | A1 | 12/2005 | Pikielny | |
| 2006/0162225 | A1 | 7/2006 | Danielson | |
| 2006/0191183 | A1 | 8/2006 | Griffin | |
| 2007/0041418 | A1 * | 2/2007 | Laughman et al. | 372/55 |
| 2007/0190495 | A1 | 8/2007 | Kendir et al. | |
| 2007/0258236 | A1 * | 11/2007 | Miller | 362/205 |
| 2007/0271832 | A1 | 11/2007 | Griffin | |
| 2008/0000133 | A1 | 1/2008 | Solinsky et al. | |
| 2008/0060248 | A1 | 3/2008 | Pine et al. | |
| 2008/0134562 | A1 | 6/2008 | Teetzel | |
| 2009/0013580 | A1 | 1/2009 | Houde-Walter | |
| 2009/0013581 | A1 | 1/2009 | LoRocco | |
| 2009/0178325 | A1 | 7/2009 | Veilleux | |
| 2009/0293335 | A1 | 12/2009 | Danielson | |
| 2010/0058640 | A1 | 3/2010 | Moore et al. | |
| 2010/0162610 | A1 | 7/2010 | Moore et al. | |
| 2010/0175297 | A1 | 7/2010 | Speroni | |
| 2010/0229448 | A1 | 9/2010 | Houde-Walter | |
| 2011/0047850 | A1 | 3/2011 | Rievley et al. | |
| 2011/0061283 | A1 | 3/2011 | Cavallo | |
| 2011/0162249 | A1 | 7/2011 | Woodmansee et al. | |
| 2012/0047787 | A1 | 3/2012 | Curry | |
| 2012/0055061 | A1 | 3/2012 | Hartley et al. | |
| 2012/0124885 | A1 | 5/2012 | Caulk et al. | |
| 2013/0185982 | A1 | 7/2013 | Hilbourne et al. | |

OTHER PUBLICATIONS

USPTO; Office Action dated Mar. 26, 2013 in U.S. Appl. No. 13/353,241.

USPTO; Advisory Action dated Jul. 13, 2012 in U.S. Appl. No. 12/249,781.

USPTO; Final Office Action dated Aug. 7, 2012 in U.S. Appl. No. 12/249,781.

(56) References Cited

OTHER PUBLICATIONS

USPTO; Notice of Allowance dated Jul. 25, 2012 in U.S. Appl. No. 12/610,213.
USPTO; Notice of Allowance dated Aug. 16, 2012 in U.S. Appl. No. 13/346,621.
EPO; Office Action dated Dec. 20, 2011 in Application No. 09169476.
USPTO; Final Office Action dated Mar. 6, 2012 in U.S. Appl. No. 12/610,213.
USPTO; Final Office Action dated May 2, 2012 in U.S. Appl. No. 12/249,781.
USPTO; Notice of Allowance dated Feb. 26, 2002 in U.S. Appl. No. 09/624,124.
USPTO; Office Action dated Jun. 11, 2001 in U.S. Appl. No. 09/624,124.
Webpage print out from http://airgunexpress.com/Accessories/ referencing various level devices.
Webpage print out from http://secure.armorholdings.com/b-square/smarthtml/about.html referencing background on B-Square and their firearm accessories.
Webpage print out from http://secure.armorholdings.com/b-square/tools_scope.html referencing scope and site tools offered by B-Square.
Webpage print out from www.battenfeldtechnologies.com/113088.html referencing a level device.
Webpage print out from www.battenfeldtechnologies.com/wheeler referencing products from Wheeler Engineering.
Webpage print out from www.blackanddecker.com/laserline/lasers.aspx referencing Black & Decker's Auto-Leveling Lasers.
Webpage print out from www.laserlevel.co.uk/newsite.index.asp referencing the laser devices available on the Laserlevel Online Store.
Shooting Illustrated, "Update on the .25 SAUM" Jul. 2005 pp. 14-15.
USPTO; Office Action dated Nov. 15, 2012 in U.S. Appl. No. 13/412,385.
USPTO; Office Action dated Feb. 1, 2013 in U.S. Appl. No. 12/249,781.
USPTO; Office Action dated Dec. 26, 2008 in U.S. Appl. No. 11/317,647.
USPTO; Office Action dated Jun. 19, 2009 in U.S. Appl. No. 11/317,647.
USPTO; Office Action dated Sep. 28, 2009 in U.S. Appl. No. 11/317,647.
USPTO; Office Action dated Feb. 24, 2010 in U.S. Appl. No. 11/317,647.
USPTO; Office Action dated Nov. 8, 2010 in U.S. Appl. No. 12/249,781.
USPTO; Final Office Action dated May 18, 2011 in U.S. Appl. No. 12/249,781.
USPTO; Advisory Action dated Aug. 22, 2011 in U.S. Appl. No. 12/249,781.
USPTO; Office Action dated Jan. 26, 2012 in U.S. Appl. No. 12/249,781.
USPTO; Notice of Allowance dated Mar. 3, 2011 in U.S. Appl. No. 12/249,785.
USPTO; Notice of Allowance dated May 13, 2011 in U.S. Appl. No. 12/249,785.
USPTO; Office Action dated Oct. 6, 2010 in U.S. Appl. No. 12/249,794.
USPTO; Notice of Allowance dated Feb. 2, 2011 in U.S. Appl. No. 12/249,794.
USPTO; Notice of Allowance dated Jul. 8, 2011 in U.S. Appl. No. 12/249,794.
USPTO; Office Action dated Oct. 18, 2011 in U.S. Appl. No. 12/610,213.
EPO; Search Opinion and Report dated Aug. 23, 2010 in Serial No. 09169476.
EPO; Search Opinion and Report dated Aug. 6, 2010 in Serial No. 0969469.
EPO; Office Action dated Oct. 5, 2011 in Serial No. 09169469.
EPO; Search Opinion and Re dated Aug. 6, 2010 in Serial No. 09169459.
EPO; Office Action dated Oct. 5, 2011 in Serial No. 09169459.
USPTO; Notice of Allowance dated May 17, 2011 in U.S. Appl. No. 13/077,861.
USPTO; Notice of Allowance dated Sep. 1, 2011 in U.S. Appl. No. 13/077,861.
USPTO; Notice of Allowance dated Nov. 18, 2011 in U.S. Appl. No. 13/077,861.
USPTO; Office Action dated Jun. 22, 2011 in U.S. Appl. No. 13/077,875.
USPTO; Notice of Allowance dated Nov. 1, 2011 in U.S. Appl. No. 13/077,875.
EPO; Office Action dated Sep. 3, 2012 in Application No. 09169469.
EPO; Office Action dated Sep. 3, 2012 in Application No. 09169476.
EPO; Office Action dated Sep. 3, 2012 in Application No. 09169459.
EPO; Search Report and Opinion dated Aug. 6, 2012 in Serial No. 11151504.
USPTO; Notice of Allowance dated Jul. 15, 2013 in U.S. Appl. No. 13/412,385.
USPTO; Notice of Allowance dated Aug. 6, 2013 in U.S. Appl. No. 13/010,649.
USPTO; Notice of Allowance dated Jul. 22, 2013 in U.S. Appl. No. 12/249,781.
USPTO; Decision on Appeal dated Aug. 20, 2013 in U.S. Appl. No. 11/317,647.
USPTO; Final Office Action dated Apr. 11, 2013 in U.S. Appl. No. 13/010,649.
USPTO; Final Office Action dated May 16, 2013 in U.S. Appl. No. 13/412,385.
USPTO; Office Action dated Jun. 19, 2013 in U.S. Appl. No. 13/353,165.
USPTO; Office Action dated Jun. 24, 2013 in U.S. Appl. No. 13/670,278.

* cited by examiner

FIG.2B1

LOW-PROFILE SIDE MOUNTED LASER SIGHTING DEVICE

CROSS REFERENCE TO RELATED APPLICATIONS

This application claims priority to and incorporates by reference the disclosure of U.S. Provisional Patent Application No. 61/433,874 entitled LOW-PROFILE SIDE-MOUNTED LASER SIGHTING DEVICE, filed on Jan. 18, 2011. To the extent not inconsistent with this disclosure, this application incorporates U.S. Pat. No. 8,006,428 entitled "Gun-Mounted Sighting Device" and U.S. patent application Ser. No. 12/249,781 entitled "Slot-Mounted Sighting Device" by reference.

FIELD OF THE INVENTION

The present invention relates to lighting devices for automatic pistols.

BACKGROUND OF THE INVENTION

It is known to attach lighting devices, such as laser sighters, to guns in order to assist with properly sighting the gun. The addition of a lighting device, however, can require machining or altering components of the gun, or the lighting device may be a high-profile component that makes it difficult or impossible to place the gun into a holster or pocket, or that makes the gun off balanced.

SUMMARY OF THE INVENTION

The present invention is a lighting device that mounts onto the side of an automatic pistol (or "gun" or "pistol," as used herein) by utilizing openings already formed in the pistol to receive insert pins, which are fasteners that connect a portion of the pistol's body to a frame rail of the gun. To install a lighting device of the invention in a retrofit application, one or more of the insert pins is first removed, usually using a simple tool such as a wrench, hex driver, or screw driver. This exposes the opening(s) into which the insert pin(s) had been positioned. Then, the lighting device (or "device," as used herein) is positioned onto the side of the pistol so that each of one or more apertures in the device align with a respective opening into which an insert pin had been positioned. Then the same insert pin, or a different and slightly longer insert pin, is inserted through each aligned aperture and hole in order to secure the device to the side of the gun, and again secure the portion of the gun's body to the frame rail.

For new equipment applications a device according to the invention could be mounted to the pistol, in which case the insert pins would not have to be removed. The device could simply be mounted with proper sized insert pins as the pistol is assembled.

Preferably, a lighting device according to the invention has a low profile and extends outward from the side of the gun by ⅜" or less. The laser used with the lighting device preferably pulses at a frequency of 1 KHz and a 50% duty cycle in order to utilize less power during operation.

BRIEF DESCRIPTION OF THE DRAWINGS

FIG. 2B1 is a front view of the main housing of the lighting device shown in FIG. 2A.

DETAILED DESCRIPTION OF PREFERRED EMBODIMENTS

Figure 1:
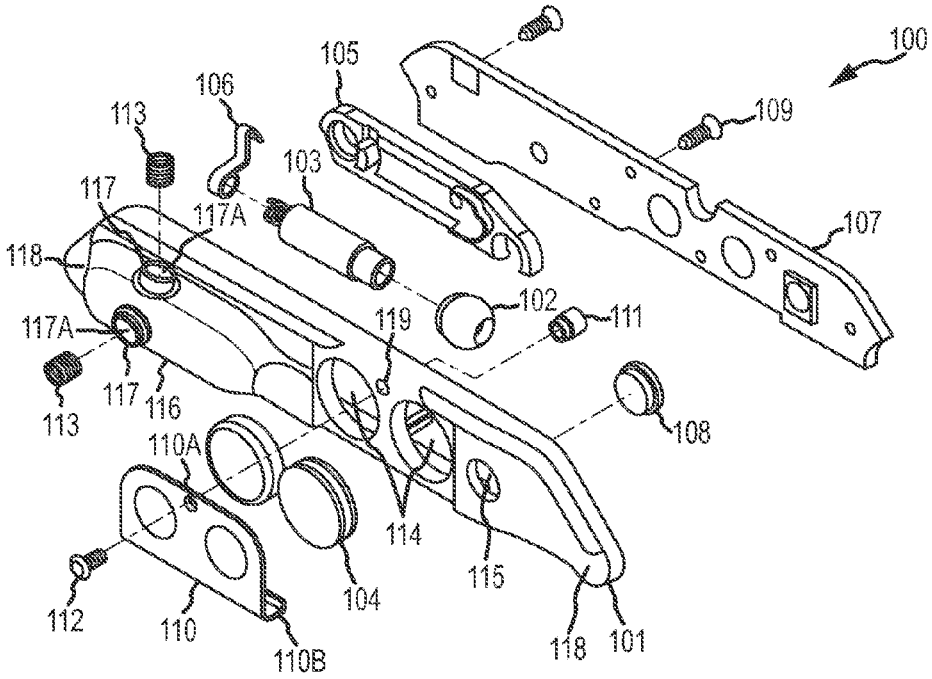
FIG. 1 is an exploded view of a side-mounted lighting device according to an aspect of the invention.
Figure 1A:
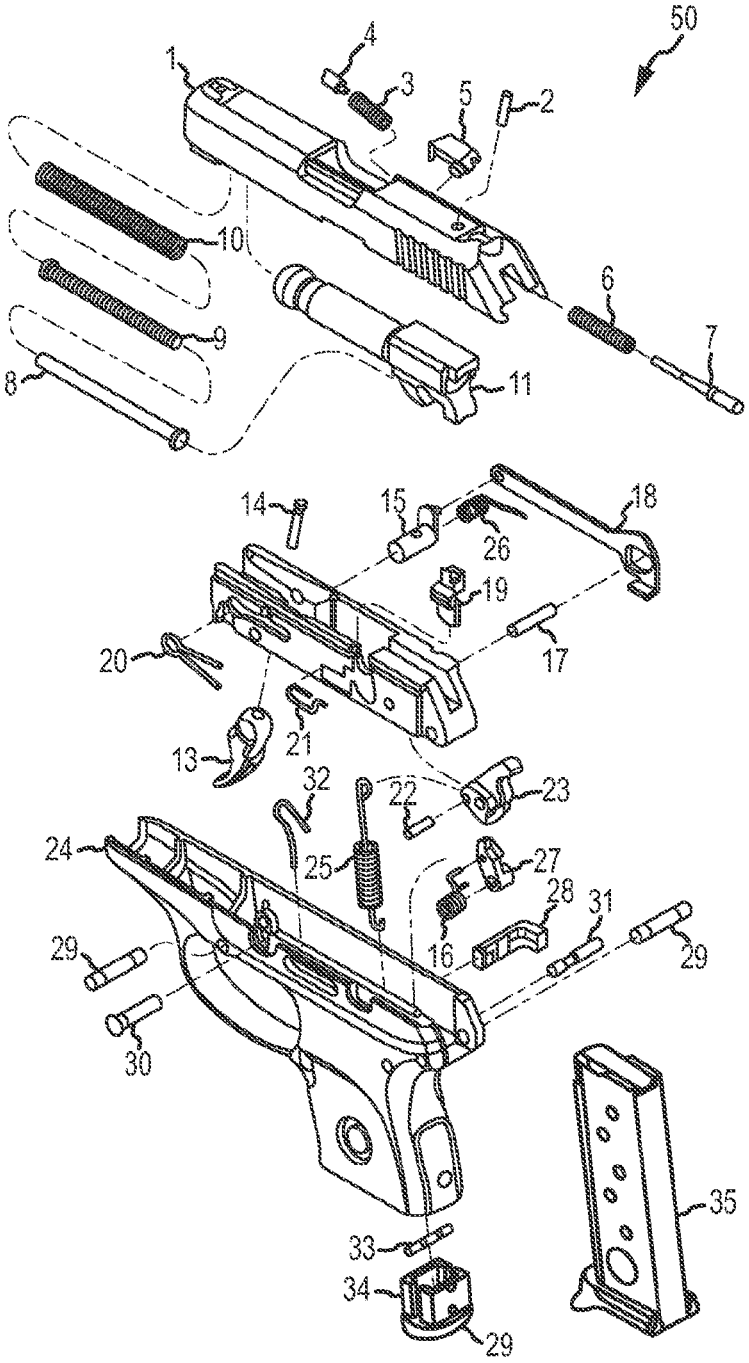
FIG. 1A is an exploded view of an automatic pistol with which a lighting device according to the invention may be used.

Turning now to the figures, wherein the purpose is to describe a preferred embodiment of the invention and not to limit same, Figure A shows an exploded view of an automatic pistol 50 on which a laser sighting device according to the invention may be used. Figure A was obtained from www.ruger.com/proudcts/_manuals/lcp.pdf.

Pistol 50 has a slide 1, a firing pin retainer 2, an extractor spring 3, and extractor plunger 4, an extractor 5, a firing pin spring 6, a firing pin 7, a guide rod 8, an inner recoil spring 9, an outer recoil spring 10, a barrel 11, a frame insert 12 having frame rails 12A, a trigger 13, a trigger pin 14, a trigger pivot 15, a hammer catch spring 16, a hammer pivot pin 17, a trigger bar 18, a hold open 19, a takedown pin detent 20, a hold-open detent 21, a hammer spring retainer pin 22, a hammer 23, a frame 24, a hammer spring 25, a trigger spring 26, a hammer catch 27, a magazine latch catch 28, two frame insert pin 29, a takedown pin 30, a hammer catch pin 31, a magazine latch spring 32, a hammer spring seat pin 33, a hammer spring seat 34 and a magazine 35.

A lighting device 100 according to the invention is shown in FIGS. 1-8. Device 100 has a main housing 101 that is preferably made of plastic, but that could be made of metal or any suitable material. Housing 101 has two openings 114 that receive batteries 104 (which are preferably 3V lithium coin cell batteries, although any suitable power source could be utilized), an opening 115 that receives an off/on button (or switch) 108, a raised housing portion 116 that houses a light source 103, which is preferably a laser module for generating laser light, and most preferably, a visible red-light laser, although it can be a green laser, LED laser, infra-red laser, or a flashlight. Device 100 is preferably about 3" long and if a laser module is used, it is preferably about ½" long.

Lighting device 100 also includes a module contact 106, module cushion ball (or ball socket) 102 (which receives the end of module 103 through which light is emitted), and laser module mount 105.

Reinforced sections 117 include apertures 117A that receive set screws 113. When device 100 is assembled, set screws 113 can be tightened or loosened to move laser light source 103 in the sideways and/or up-and-down directions in order to align it with the barrel of a gun to which device 100 is attached. Apertures 118 are configured to receive insert pins (also called frame insert pins) 29 in order to connect device 100 to a gun that is an automatic pistol, such as pistol 50, in the manner described herein. An insert pin may be threaded or have any attachment structure suitable of connecting device 100 to a gun, such as automatic pistol 50.

A backing 107 is also a circuit board that includes the circuitry that connects power from batteries 104 to laser module 103 and such circuitry is known to those skilled in the art.

A battery retention plate 110 is held in place by a screw (or other fastener) 112 that passes through opening 110A, through opening 119 and is retained by thread insert 111. Plate 110 has a bottom ledge 110B that receives the bottom edge of main housing 101.

Figure 2A:
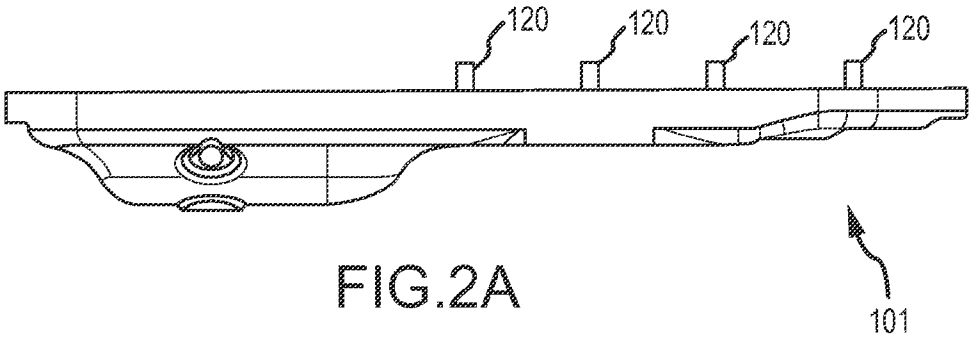
FIG. 2A is a top view of a main housing of a lighting device according to an aspect of the invention.
Figure 2B:
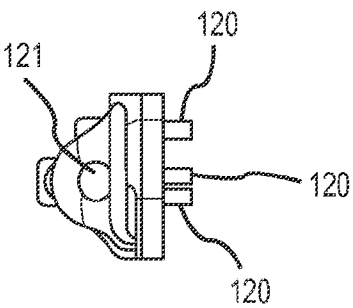
FIG. 2B is a side view of the main housing of the lighting device shown in FIG. 2A.
Figure 2B:
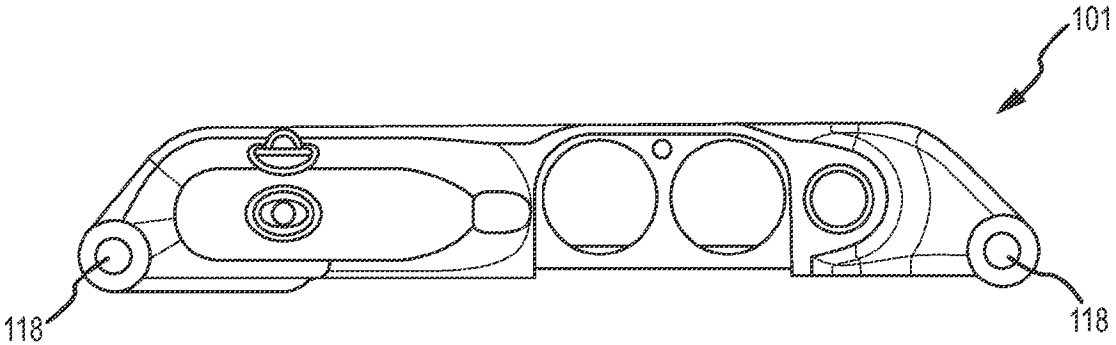
Figure 2C:
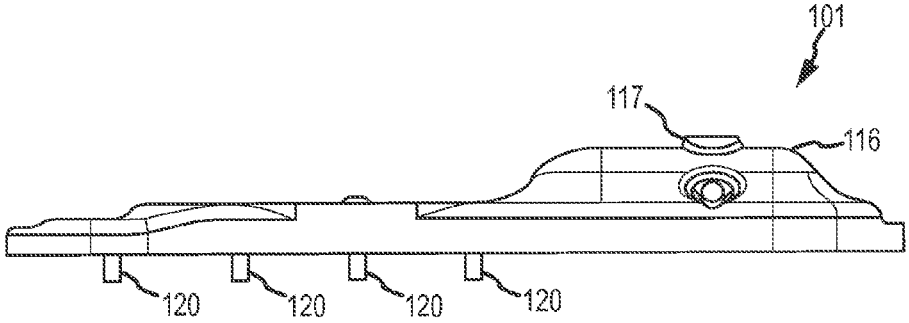
FIG. 2C is another side view of the main housing of the lighting device of FIG. 1.
Figure 2D:
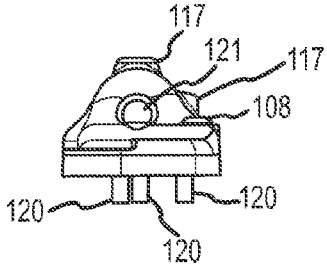
FIG. 2D is a front view of the main housing of the lighting device of FIG. 1.
Figure 7:
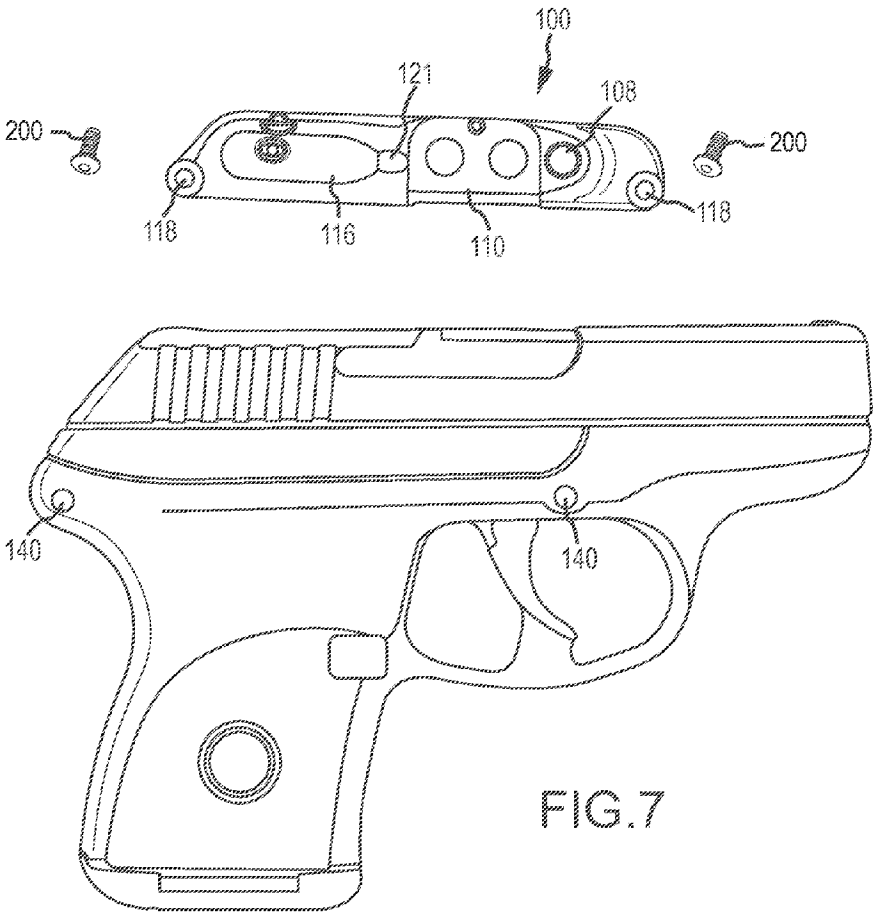
FIG. 7 is a side view of the assembled lighting device of FIG. 1, an automatic pistol to which the device is to be mounted, and fasteners (also called insert pins or frame insert pins) used to mount the laser sighting device to the pistol.

FIG. 2A shows a top view of main housing 101. Locator pins 120 are used to locate circuit board 107 onto main housing 101. FIG. 2B is a front view of the main housing 101. FIG. 7 is a front view of main housing 101, which shows the opening 121 through which laser light is emitted when module 103 is positioned in the assembled device 100. FIG. 2C is another side view of the main housing 101 and FIG. 2D is another front view of main housing 101, each without circuitry 107 attached. Screws 109 hold the circuitry 107 to main housing 101 and retain device 100 in its assembled position.

Figure 3:
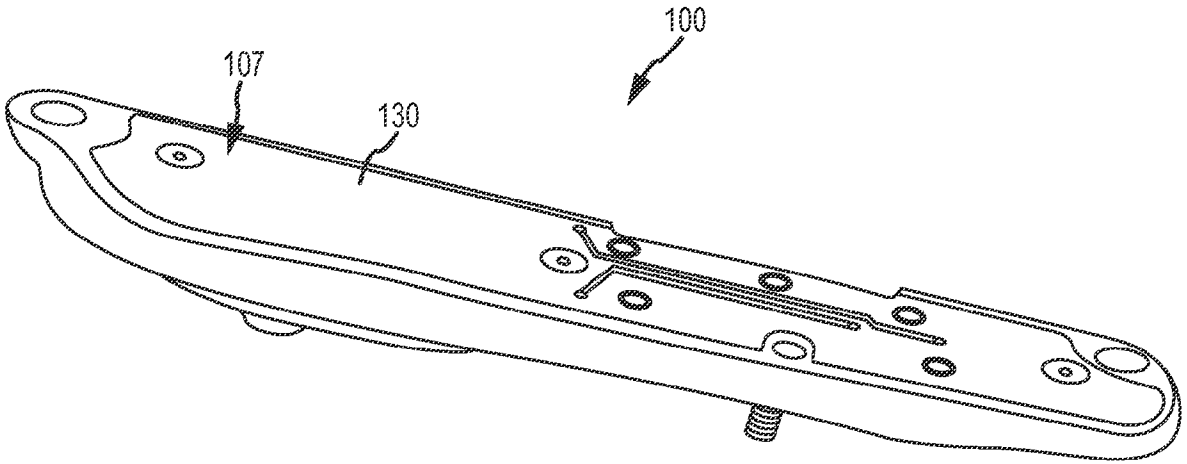
FIG. 3 is a bottom, perspective view of a lighting device according to FIG. 1.

FIG. 3 is a bottom, perspective view of the device 100 fully assembled, with circuitry 107 attached to main housing 101 and showing a bottom surface 130. FIG. 11 is a top view of the fully assembled device 100. FIG. 12 is a bottom view of fully assembled device 100 showing circuitry 107.

Figure 4:
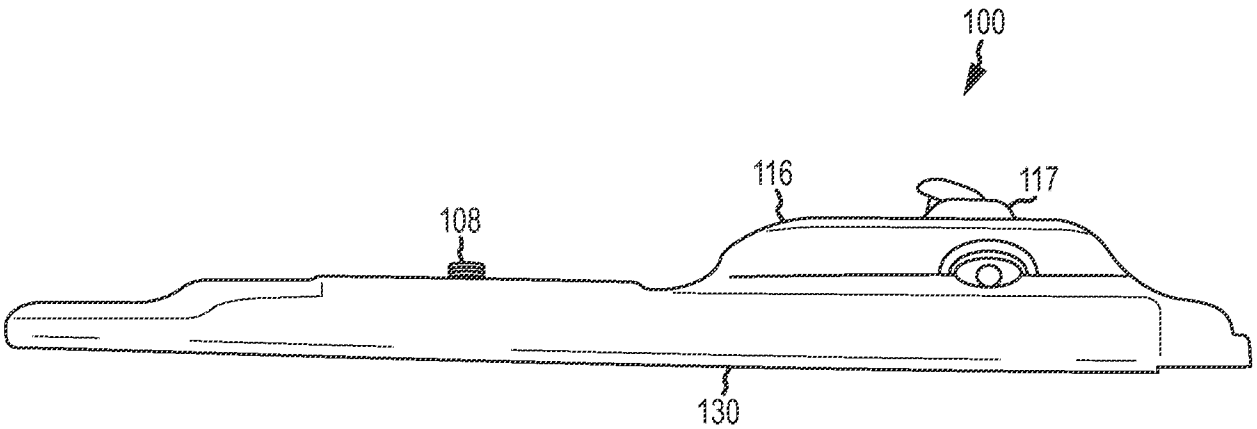
FIG. 4 is a top view of a lighting device according to FIG. 3.

FIG. 4 is a side view of the fully assembled device 100 showing, among other features, the raised portion 116 of the housing, an aperture 117 that receives a set screw 103, and on/off switch 108.

Figure 5:
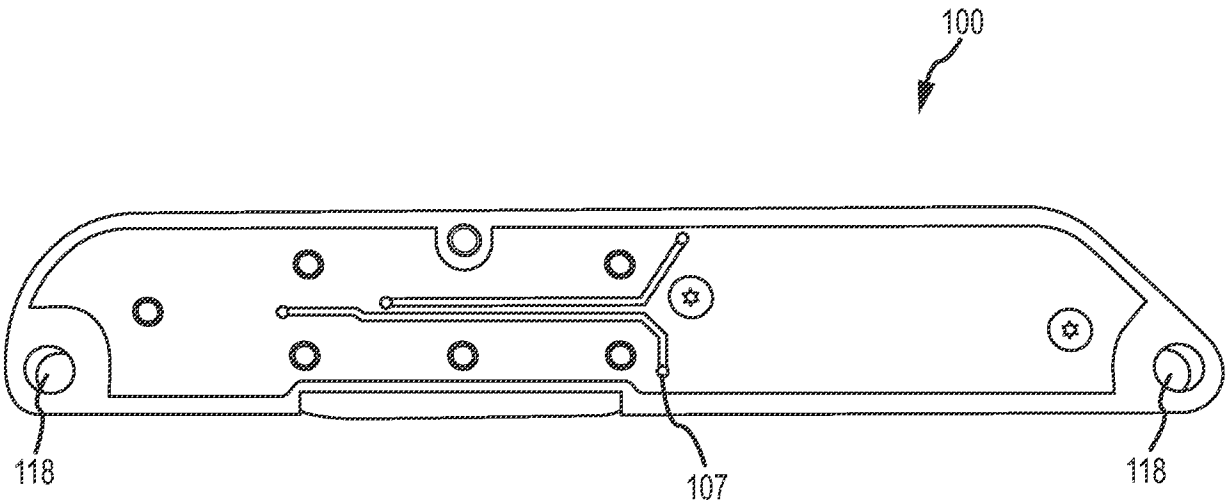
FIG. 5 is a bottom view of a lighting device according to FIG. 3.
Figure 6:
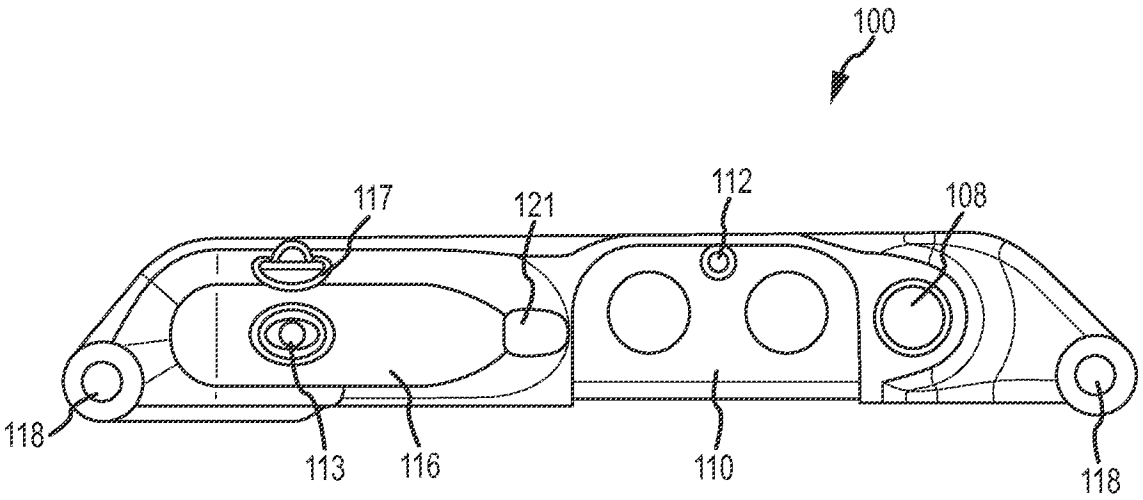
FIG. 6 is a side view of an assembled lighting device according to FIG. 1.

FIG. 5 shows backing/circuit board 107. Circuit board 107 connects the light source 103 to batteries 104, and when the light source 103 is a laser, preferably causes the laser to pulse at a frequency of 1 KHz and operate at a 50% duty cycle when turned on and operating in a continuous mode. Circuit board 107 could also cause the laser to operate in a blink mode. Circuit board 107 may also include a time-out circuit, wherein the time-out circuit turns the laser off after the laser has been on for a predetermined time, for example, when the laser has been on for five minutes.

Circuit board 107 could also be designed to cause the laser to (1) operate at about 12 mA at 3V, and/or at a 50% duty cycle.

Figure 8:
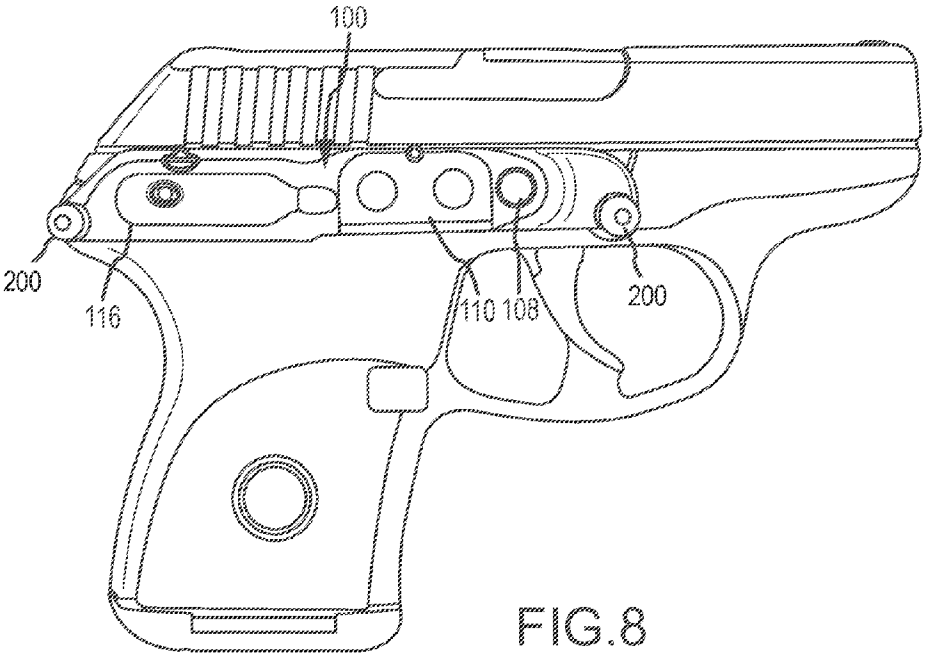
FIG. 8 is a side view of the assembled lighting device of FIG. 1 attached to the pistol shown in FIG. 7.

FIG. 7 shows a side view of device 100 prior to being mounted on an automatic pistol of the type in FIG. 1 in a retrofit application. Here, the insert pins 29 have been removed from openings 140 of the pistol. In this case, lighting device 100 will be positioned against the side of the pistol with exposed openings 140 and each of apertures 118 will be aligned, respectively, with an opening 140. Here, new insert pins 200 (which are slightly longer than removed insert pins 29 in order to compensate for the thickness of device 100) will be placed through apertures 118 and openings 140 and threaded into a frame rail 112A (not shown here), which is inside of the pistol. That will secure device 100 and the body portion of the pistol to the frame rail, as is best seen in FIG. 8. The structures and method of assembly of the pistol body portion to the frame rail using insert pins is known to those in the art.

As shown in FIG. 8, when assembled on a pistol, in this embodiment the lighting device 100 is positioned behind and above the trigger guard of the gun to which it is mounted. It is also positioned above the grip, so device 100 does not interfere with a user's grip of the gun or use of the trigger. Furthermore, the light is a laser module positioned in raised portion 116, which is behind and positioned higher on the gun than the trigger guard. Raised portion 116, which is the highest portion of device 100, extends outward no more than ⅜" from the side of the pistol to which it is mounted. Consequently, a pistol including device 100 is relatively easy to holster or place in a pocket, and device 100 does not interfere with aiming the pistol.

Having thus described some embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired result.

What is claimed is:

1. A lighting device for being mounted on the side of an automatic pistol that has a body portion and a frame rail, wherein the lighting device has a light source, a power source, circuitry connecting the power source to the light source, and at least two apertures, and is configured to be mounted to the automatic pistol by aligning a first of the at least two apertures with a first existing opening in the side of the pistol, and aligning a second of the at least two apertures with a second existing opening in the side of the pistol, and positioning an insert pin through each aligned aperture and opening to secure the lighting device onto the frame rail of the pistol.

2. The lighting device of claim 1 wherein the light source is a laser.

3. The lighting device of claim 2 wherein the laser is a red laser.

4. The lighting device of claim 2 wherein the laser is a green laser.

5. The lighting device of claim 1 wherein the light source is a flashlight.

6. The lighting device of claim 2 wherein the laser pulses at a frequency of 1 KHz and a 50% duty cycle when the laser is turned on.

7. The lighting device of claim 1 wherein the light source is controlled by a switch that turns the light source off or on.

8. The lighting device of claim 2 that includes a time-out circuit, wherein the time-out circuit turns the laser off after the laser has been on for a predetermined time.

9. The lighting device of claim 8 wherein the predetermined time is 5 minutes.

10. The lighting device of claim 2 wherein the laser is designed to operate at about 12 mA at 3V, and is operated at a 50% duty cycle.

11. The lighting device of claim 2 wherein the laser is configured to operate on a continuous mode or on a blink mode.

12. The lighting device of claim 11 wherein, when in the continuous mode, the laser pulses at 1 KHz at a 50% duty cycle.

13. The lighting device of claim 1 that is about 3" or less in length.

14. The lighting device of claim 1 that is about ½" in height at its highest point.

15. The lighting device of claim 2 that includes a laser module that is about ½" in length.

16. An assembly comprising (a) an automatic pistol having a body portion, a frame rail to which the body portion is attached, a trigger guard, and (b) a lighting device as described in claim 1 attached to the body portion of the automatic pistol by at least one insert pin passing through the lighting device, the body portion and being received in the frame rail.

17. The assembly of claim 16 wherein the lighting device extends ⅜" or less from the body portion.

18. The assembly of claim 17 wherein the light source is positioned behind the trigger guard.

19. The assembly of claim 18 wherein the lighting device has a highest point and the highest point is behind the trigger guard.

20. The assembly of claim 19 wherein the body portion is comprised of plastic.

21. The assembly of claim 20 wherein the frame rail is metal.

22. The assembly of claim 21 wherein the frame rail is steel.

23. A method of attaching a light source to an automatic pistol having a body portion and a frame rail, the method comprising the steps of:

removing insert pins that hold the body portion to the frame rail;

positing the light source on the body portion so that apertures in the light source align with openings in the body portion from which the insert pins were removed;

retaining the body portion and light source to the automatic pistol by inserting the insert pins or new insert pins into the aligned apertures and openings, where they are received and retained in the frame rail.

24. The method of claim 23 wherein the insert pins used to retain the body and light source are longer than the insert pins removed from the automatic pistol.

* * * * *